US007200891B1

(12) United States Patent
McCulloch et al.

(10) Patent No.: US 7,200,891 B1
(45) Date of Patent: Apr. 10, 2007

(54) TOOL CLEANING BRUSH ASSEMBLY

(76) Inventors: Ellis G. McCulloch, 2186 N. 3000 W., Rexburg, ID (US) 83440; DeWayne P. McCulloch, 237 6th St., Idaho Falls, ID (US) 83401; Michael T. McCulloch, 2186 N. 3000 W., Rexburg, ID (US) 83440; Julie M. McCulloch, 2186 N. 3000 W., Rexburg, ID (US) 83440

( * ) Notice: Subject to any disclaimer, the term of this patent is extended or adjusted under 35 U.S.C. 154(b) by 0 days.

(21) Appl. No.: 10/951,899

(22) Filed: Sep. 29, 2004

(51) Int. Cl.
*A46B 7/00* (2006.01)
*A46B 9/02* (2006.01)

(52) U.S. Cl. ..... 15/104.92; 15/106; 15/160

(58) Field of Classification Search ..... 15/104.92, 15/160, 106
See application file for complete search history.

(56) References Cited

U.S. PATENT DOCUMENTS 180,717 A * 8/1876 Isaacs ..... 15/160
3,872,534 A * 3/1975 Hoag ..... 15/88.1
4,965,906 A * 10/1990 Mauro ..... 15/104.92
5,398,363 A * 3/1995 Medearis et al. ..... 15/104.92
5,652,993 A 8/1997 Kreyer
5,794,301 A 8/1998 Hietala
6,745,424 B1 * 6/2004 Pimentel et al. ..... 15/21.2
2002/0152568 A1 10/2002 Dillinger

* cited by examiner

*Primary Examiner*—Randall Chin

(57) ABSTRACT

A cleaning assembly for substantially flat tools is described. The assembly includes a bucket-like container which mounts interior opposed horizontally oriented brushes. The brushes are affixed by their brush backs to the interior surface of the container with working ends abutting, or they may be releasably secured to this surface. Each set of brushes is contained in a parallel horizontal plane and each pair of brushes being mutually spaced vertically. The upper most pair of brushes has working ends contained in one of a pair of vertical planes, and the second set of brushes has working ends contained either a pair of vertical planes, or in a single vertical plane.

7 Claims, 3 Drawing Sheets

TOOL CLEANING BRUSH ASSEMBLY

FIELD OF THE INVENTION

This invention relates to an assembly for cleaning a variety of hand tools and in particular to a brush assembly within a container for solvent through which spatula type tools can be reciprocated to remove debris and building materials from the surfaces thereof.

DESCRIPTION OF THE PRIOR ART

Hand tools including tile setting tools such as trowels, paddle mixers and the like as well as other conventional hand tools such as wrenches, screwdrivers, shovels and similar types of tools often accumulate materials on the outer surfaces which should be removed periodically for efficiency of use of the tools. In a construction project, the tools must be cleaned as needed, and at least at the end of the day, and cleaning by hand as with a scraper or the like is time consuming and not very efficient.

In U.S. Pat. No. 5,652,993 an assembly is described for removing ink from a knife blade. The assembly includes a container with a plate heading a central aperture which is suspended from the top of the container, and a pair of facing brushes are mounted to the underside of the plate on opposed sides of the central aperture. The knife is then reciprocated through the plate aperture against the brush tips and into a solvent disposed within the container to remove ink there from. The plate is suspended by hooks from the sides of the container and involves a number of different parts for suspending the brushes. Only a single pair of brushes is provided.

U.S. Pat. No. 5,794,301 describes folding chair washer which also uses a container holding a cleaning fluid or rinsing fluid. A plurality of opposed stock brushes are mounted on a framework which is suspended within the container resting on the top thereof. Chairs are then inserted into the container through the framework and brushes and reciprocated to remove debris there from.

In U.S. patent published application No. 2002/0152568 A1 a system is described for cleaning the exterior and interior of drywall tool. The system includes a bucket and metal frame and brushes. The brushes are rigidly mounted to the frame and extend longitudinally upwardly. This device requires an exterior pump for pumping water through the interior of the tool as it is scrubbed against brushes within the bucket. The brushes are oriented vertically, around the interior of the bucket and are mounted on the frame. Openings are provided between the brushes and an open space is provided between bristles of opposite brushes. As in the other prior art devices, the tool to be cleaned is manually reciprocated against the bristles in the water or solvent as the pump supplies water through the interior of the tool.

Accordingly there remains a need for a rapid and efficient assembly for cleaning substantially flat tools which includes brushes, the working ends thereof which are opposed and abutting and which does not include a separate carrier for the brushes. The carrier shown in the prior art cleaning assemblies includes multiple separate pieces which can become lost or separated from the assembly at a job site thereby rendering the assembly useless.

SUMMARY OF THE INVENTION

It has been discovered that a rapid and efficient assembly for cleaning substantially flat tools such as trowels, paddle mixers, shovels and hand tools such as wrenches, hammers, screwdrivers and the like can be provided wherein the cleaning brushes are mounted within the solvent container against the sides thereof. In one embodiment of this invention the brushes are rigidly affixed to the interior sides of the container so that they cannot become separated from the container and a separate carrier for the brushes is not needed. The brushes in this embodiment consist of two pairs of horizontally opposed brushes, at least the upper pair of brushes having a configured working end whereby insertion of the tool between the brushes and reciprocation thereof results in different scrubbing action being applied to different surfaces depending upon orientation of the tool there within.

The lower portion of the brush assembly in this first embodiment includes a pair of opposed brushes having bristles of substantially the same length whereas the upper assembly includes brushes having at least two different lengths, the working ends of which form a mirror image of each other. The container preferred is a 5-gallon plastic bucket and any solvent can be used including water.

When the cleaning operation is complete the bucket is merely emptied, the brushes hosed down, and refilled with clean water or solvent.

In a second embodiment of this invention two pairs of horizontally opposed brushes having a configuration similar to that of the first embodiment described above are provided in a container, but the brushes are removable for cleaning or replacement. In this embodiment, individual brush backs mounting tufts are affixed to a pair of vertically spaced T shaped carriers which in turn are removably affixed to the side of the container as for example with conventional screws.

While continued use will cause a certain amount of wear where the screws pass through a conventional five gallon, plastic bucket, this embodiment has the advantage of having removable brushes if they become embedded with debris. The removable brush assemblies can either be cleaned or discarded and replaced.

Accordingly it is an object of this invention to provide a cleaning assembly for flat or substantially flat tools wherein at least two pairs of brushes are vertically stacked within a container and affixed at one end thereof to the sides of the container. The working ends of the brushes abut each other forming a central slit for receiving the tool to be cleaned there between.

It is another object of this invention to provide a brush cleaning assembly for substantially flat tools such as trowels, mixing paddles, shovels and the like wherein two pairs of brushes are vertically mounted against the interior sides of a container the working ends of which abut to receive the tool to be cleaned there between.

It is a further object of this invention to provide a brush cleaning assembly wherein at least two pairs of opposed brushes extend horizontally from the interior sides of a container, the upper pair of brushes having working ends which are contained horizontally within two vertical planes and which working ends abut each other.

It is yet another object of this invention to provide a brush cleaning assembly wherein at least two pairs of opposed brushed extend horizontally from interior sides of a container wherein each of said pairs of brushes is rigidly affixed to the interior surface of the container so that the brushes are not removable therefrom.

It is still another object of this invention to provide a brush cleaning assembly wherein at least two pairs of opposed brushes extend horizontally from interior sides of a container, each brush being affixed to a T-shaped carrier which in turn is removably attached to the interior surface of the container so that the brushes can be removed from the container for individual cleaning or replacement.

These and other objects will become readily apparent with reference to the drawings and following description wherein:

DETAILED DESCRIPTION OF THE INVENTION

Figure 2:
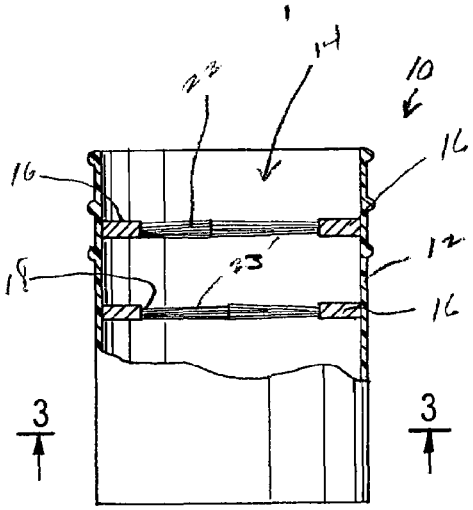
FIG. 2 is a partial sectional view taken along lines 2—2 of FIG. 1.
Figure 1:
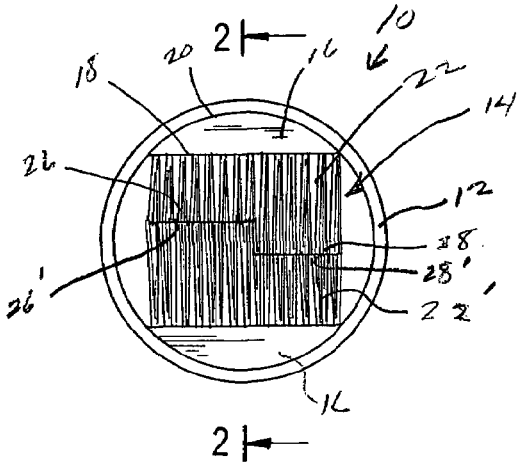
FIG. 1 is a top view of a first embodiment of the cleaning assembly of this invention.
Figure 3:
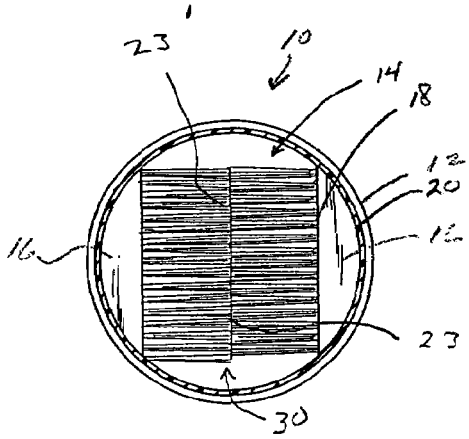
FIG. 3 is a cross sectional review taken along line 3—3 of the device of FIG. 2.

With the attention to the FIGS. 1–3, the embodiment of this invention 10 uses a container 12 for water or another solvent used to clean the tools (not shown). The preferred container is a 5-gallon bucket of conventional design.

The container 12 mounts a plurality of brushes 14 preferably in upper and lower horizontal orientations mutually spaced vertically apart. Brushes 14 consist of brush backs 16 which may be affixed by conventional adhesive material to the inner surface of the container 12. Any conventional adhesive compatible with the materials of construction can be used. Each brush back 16 has an arcuate back surface 20 which abuts the inner surface of the container 10.

Each brush back 16 has a forward surface 18 which mounts individual tufts of bristles 22 or 22'.

Brushes 14 may be supplied by Tucel Industries, Inc. of Forestdale, Vt. In the preferred brushes each brush back is molded from a plastic material such as polyurethane and the tufts of bristles 22 and 22' are individual tufts of cut to length monofilament bristles which are fused at the non-working ends to the brush back surface 18. As will be obvious to those skilled in the art, however, this invention is not intended to be limited to the type of brush construction and any conventional brush, as shown in the drawings herein, any conventional brush could be used.

Figure 4:
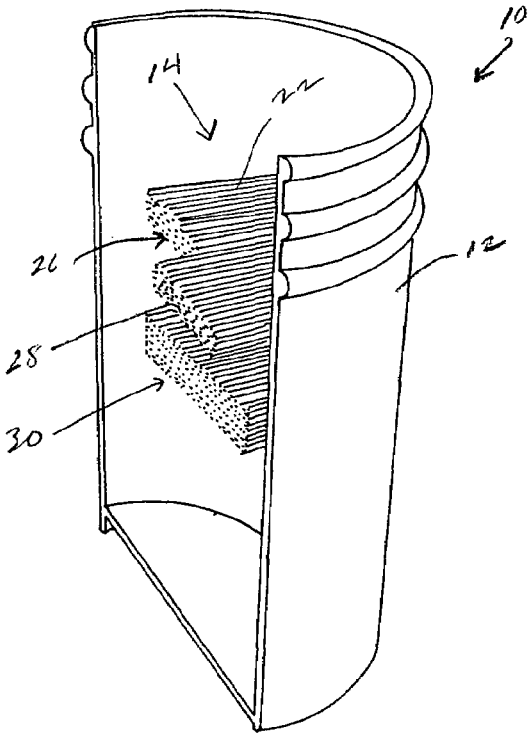
FIG. 4 is a vertical sectional view with one half of the device of this invention removed.

As shown, for example, in FIGS. 1 and 4, the working ends 26 and 28 of bristles 22 are contained, respectively, in two different vertical planes which are mutually spaced horizontally from each other. The working ends of opposed brushes 22 and 22' abut so that the working ends of brushes 22 and 22', 26 and 26' and 28 and 28' are contained in abutting parallel vertical planes. The different lengths of these bristles improve frictional engagement with a tool surface passing through the working ends.

With attention to FIG. 3, the lower brush assembly has similar bristles 23 and 23' which are mounted in brush blocks 16. In this instance however the working ends of the bristles 23 and 23' for each brush 30 are contained in a single vertical plane, and the working end of each brush 30 abuts the opposite brush working end.

In order to clean a tool (not shown), the tool is inserted downwardly through the working ends of tufts 22 and 22', and through the working ends of tufts 23 and 23' into a solvent or water solution contained within the bucket 12. A tool is then reciprocated against the working ends of the brushes until debris is removed. Manual scraping should be unnecessary, and the orientation of the working ends of the various brushes facilitates frictional action against the debris on various tools to loosen the same so that it drops through the brushes into the bucket 12.

After cleaning then the bucket is emptied, rinsed, and refilled with water or whatever solvent is used.

Figure 5:
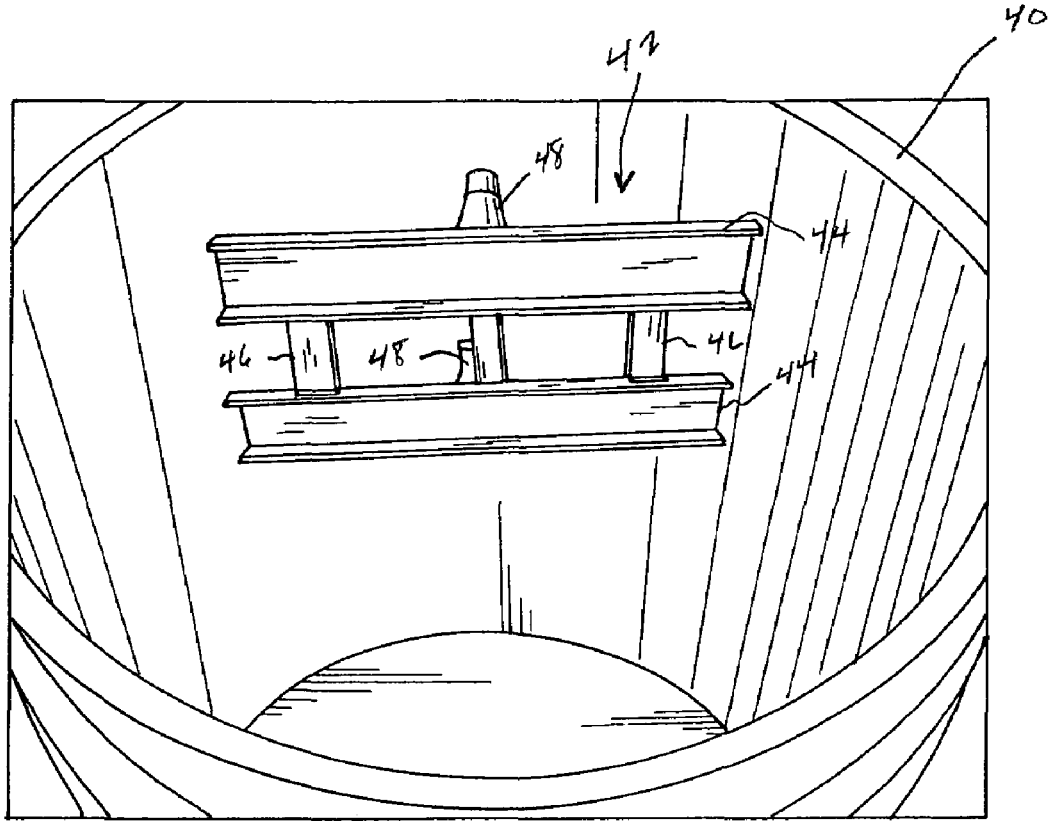
FIG. 5 is a fragmentary perspective view of a second embodiment of this invention.
Figure 6:
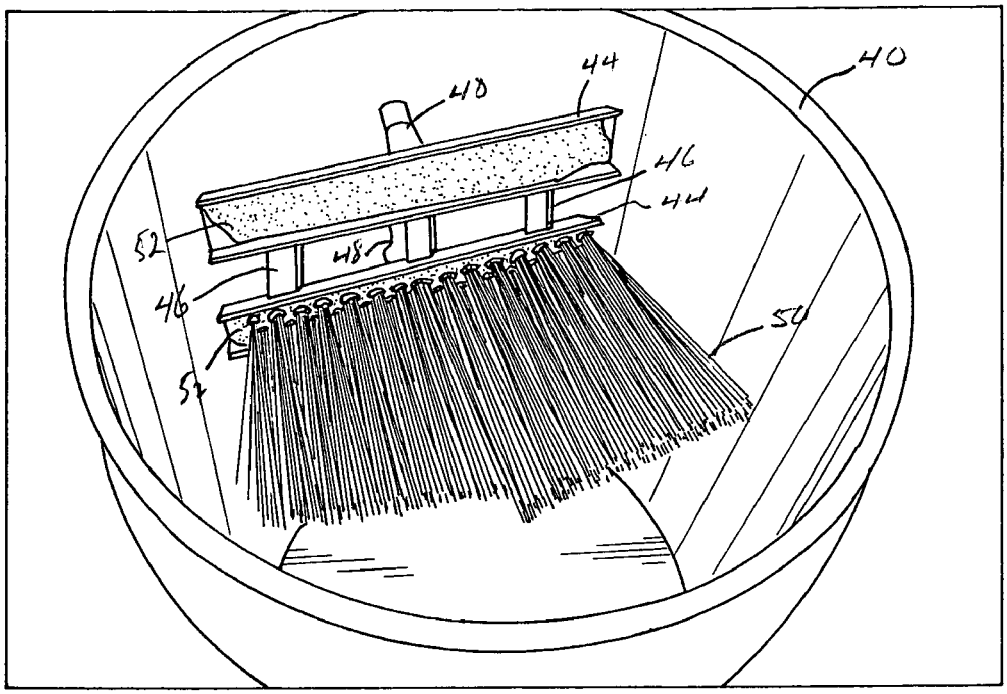
FIG. 6 is a fragmentary perspective view of the embodiment of FIG. 5 with the uppermost brush assembly removed.
Figure 7:
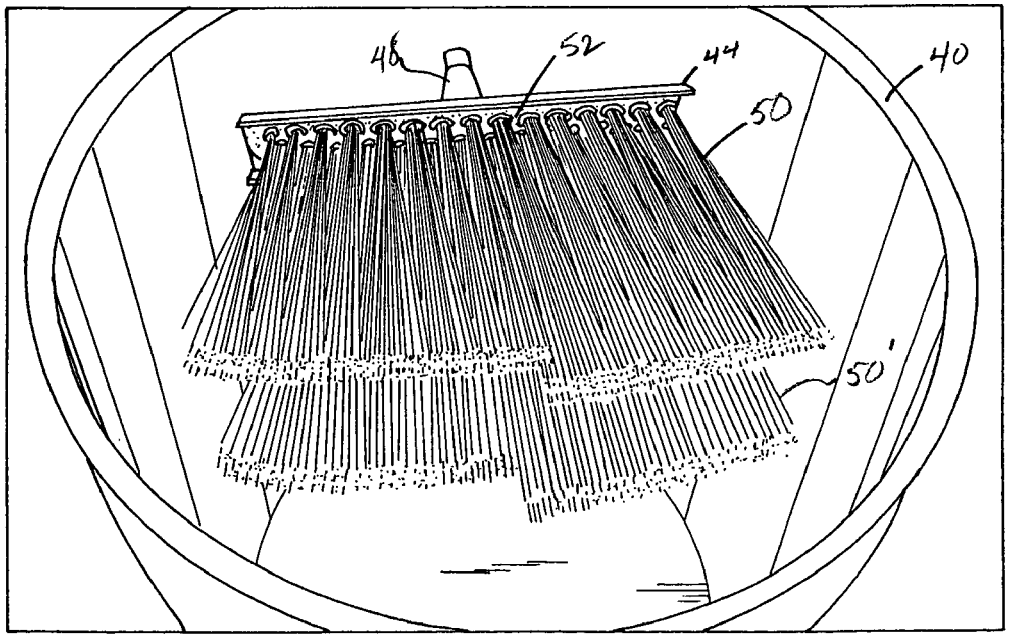
FIG. 7 is a view similar to FIG. 6 showing two brush assemblies.

With attention to the embodiment of FIGS. 5–7, in the second embodiment of this invention, removable brush assemblies are provided so that the brush assembly can be taken from the container, cleaned or discarded and replaced. The container 40 which mounts opposed, T-shaped brush mount assemblies 42. FIGS. 5–7, for simplicity, show only a single brush mount assembly 42, but this invention contemplates, as shown in the first embodiment, opposed brush mount assemblies which are mirror images of each other. Each T-shaped assembly 42 includes a pair of channel shaped brush mounts 44 which are rigidly affixed to vertical supports 46. The assembly 42 is mounted to the bucket 40 by a pair of central legs 48 which extend horizontally from channels 44. The container 40 has holes (not shown) which are aligned with members 46, and each hole receives a conventional screw (not shown) which engages each member 48 to support the same. By removal of the screws, the entire assembly 42 can be removed from the container 40.

With attention to FIGS. 6 and 7, each channel 44 mounts an upper brush 50 and a lower brush 50'. In this embodiment, brushes 50 and 50' are configured similar to brush 22 in the embodiment of FIGS. 1–4. It is intended within the scope of this invention that the working ends of the lower brush can be similar to brush working ends 22 and 22', or 23 and 23' in the above described first embodiment.

In the second embodiment, each brush is formed by a plurality of cut to length synthetic fibers which are fused onto a brush back 52 and each brush back is secured within a channel 44 by a conventional adhesive.

As noted above then removal of the screws (not shown) from supports 48 will free the entire assembly 42 from the container 40 for removal. This will facilitate either the replacement of the brush assembly, or cleaning thereof for replacement within the container 40.

While the drawings show upper and lower sets of brushes within the bucket, this invention is not intended to be limited to 2 sets of said brushes. If desired a plurality of lower brushes can be provided.

It will be readily seen by one of ordinary skill in the art that the present invention fulfills all of the objects set forth above. After reading the foregoing specifications, one of ordinary skill will be able to effect various changes, substitutions or equivalents and various other aspects of the invention as broadly disclosed herein. It is therefore intended that the protection granted hereon be limited only by the definition contained in the appended claims and equivalents thereof.

What is claimed is:

1. A tool cleaning brush assembly comprising:

a bucket-like container having an open top and a substantially vertical side having an interior and an exterior surface;

a plurality of opposed pairs of brushes, each pair horizontally oriented within said container, said pairs being vertically stacked within said container, each brush having a brush back with front and rear surfaces, said front surfaces mounting a plurality of bristles by the non-working ends thereof, said rear surfaces being mounted on the interior surface of said container; at least the uppermost pair of said brushes having bristles with working ends contained within one of two different horizontally spaced first and second vertical planes, the working ends of opposed brush bristles abutting;

the container being circular in cross-section and the rear surface of each brush back being arcuate to match the circular configuration of said container side.

2. The assembly of claim 1 further comprising at least a second pair of opposed brushes, each brush back being mounted on the interior surface of said container, spaced vertically below said uppermost pair of brushes, the working ends of each of said second pair of brushes being contained within a single third vertical plane with the working ends of each brush abutting.

3. The assembly of claim 1 wherein a surface of each brush back is rigidly affixed to said interior container surface.

4. The assembly of claim 1 wherein the container is circular in cross section, and each brush back is supported by a horizontal channel receiving said brush back, each of said channels releasably affixed at the interior surface of said container, and rigidly affixed to each other.

5. The assembly of claim 4 wherein each of said channels has a central support post which extends horizontally to the side of the container and is releasably affixed thereto.

6. The assembly of claim 4 wherein a second pair of said opposed brushes is provided, each brush back being mounted on the side of said container, spaced vertically below said uppermost pair of brushes, the working ends of said bristles on each brush being contained within one of two different horizontally spaced first and second vertical planes so that about one half of the working ends of said bristles are contained in a first of said planes, and the other half contained in a second of said planes.

7. The assembly of claim 1 comprising first, second and third pairs of vertically stacked brushes, the working ends of each brush being contained in a vertical plane.

* * * * *